US005983796A

United States Patent [19]

Ishida et al.

[11] Patent Number: 5,983,796

[45] Date of Patent: Nov. 16, 1999

[54] REMAINING PAPER DETECTION APPARATUS FOR SHEET-FED ROTARY PRINTING PRESS

[75] Inventors: Masaaki Ishida; Yoshiro Hatakeyama, both of Ibaragi, Japan

[73] Assignee: Komori Corporation, Tokyo, Japan

[21] Appl. No.: 09/152,850

[22] Filed: Sep. 14, 1998

[30] Foreign Application Priority Data

Sep. 22, 1997 [JP] Japan ..... 9-256532

[51] Int. Cl.[6] ..... B41F 13/24

[52] U.S. Cl. ..... 101/232; 271/258.01; 271/265.01

[58] Field of Search ..... 101/232, 233, 101/234, 242; 399/23; 271/258.01, 259, 265.01, 265.02

[56] References Cited

U.S. PATENT DOCUMENTS

| | | | |
|---|---|---|---|
| 3,970,384 | 7/1976 | Yamamoto et al. | 271/259 X |
| 4,015,523 | 4/1977 | Evans et al. | 101/233 |
| 4,310,153 | 1/1982 | Kikuchi | 271/259 |
| 5,280,322 | 1/1994 | Kono | 271/259 X |
| 5,365,322 | 11/1994 | Hamada et al. | 271/259 X |
| 5,564,842 | 10/1996 | Kida et al. | 400/185 |
| 5,697,608 | 12/1997 | Castelli et al. | 271/228 |
| 5,727,784 | 3/1998 | Sagawa | 271/265.01 |

FOREIGN PATENT DOCUMENTS

| | | |
|---|---|---|
| 2013632 | 8/1979 | United Kingdom . |
| 2192584 | 1/1988 | United Kingdom . |

OTHER PUBLICATIONS

Patent Abstracts of Japan vol. 009, No. 272 (M–425), Oct. 30, 1985.

*Primary Examiner*—Edgar Burr
*Assistant Examiner*—Minh H. Chau
*Attorney, Agent, or Firm*—Blakely Sokoloff Taylor & Zafman

[57] ABSTRACT

The apparatus includes a print switch, the remaining paper detection apparatus, and a controller and a remaining paper detection controller. The print switch sets a printing press to a printing operation mode. The remaining paper detection apparatus detects remaining paper sheets on a convey board. The controller and remaining paper detection controller inhibit the print switch from setting the printing operation mode when a remaining paper sheet is detected by the remaining paper detection apparatus.

10 Claims, 6 Drawing Sheets

REMAINING PAPER DETECTION APPARATUS FOR SHEET-FED ROTARY PRINTING PRESS

BACKGROUND OF THE INVENTION

The present invention relates to a remaining paper detection apparatus for detecting a paper sheet left on a convey board arranged between the feeder and printing unit of a sheet-fed rotary printing press.

Generally, in the printing operation, the required quality is confirmed by test printing of a proofing print, printing copy, or the like, and thereafter final printing is performed. Test printing is repeated until quality matching is confirmed. Even in final printing, various operations, e.g., a blanket cleaning work, are performed as required in order to maintain the printing quality. In this manner, final printing is performed repeating interruption and resumption of printing, and accordingly paper feeding is performed repeating interruption and resumption. Therefore, a state wherein a fed paper sheet remains on a convey board often occurs.

Since a remaining paper sheet is not fed with a normal timing, misregistration may occur or the paper sheet may skew. If the paper feed operation is resumed while leaving the remaining paper sheet as it is, the paper sheet may be torn at the register or a torn paper piece may enter into the printing unit. To remove this torn paper piece, the blanket, the ink roller, the dampening roller, and the like must be cleaned unnecessarily.

If the paper sheet in a bent state is conveyed between printing units, it may damage the blanket or the respective portions of the machine, or be caught in the ink roller or the like. When such an accident occurs, an extra time is required to settle it, leading to a decrease in productivity and quality. Conventionally, the operator himself visually confirms the remaining paper sheets before the start of paper feed operation, imposing an extra load on the operator.

SUMMARY OF THE INVENTION

It is an object of the present invention to provide a remaining paper detection apparatus for a sheet-fed rotary printing press, in which an accident accompanying a remaining paper sheet is prevented and the stability of the printing quality is maintained.

It is another object of the present invention to provide a remaining paper detection apparatus for a sheet-fed rotary printing press, in which an extra work time and cost necessitated upon occurrence of an accident caused by remaining paper sheets are reduced to increase the productivity.

It is still another object of the present invention to provide a remaining paper detection apparatus for a sheet-fed rotary printing press, in which various types of works accompanying confirmation of a remaining paper sheet and settlement of an accident are eliminated to decrease the load on the operator.

In order to achieve the above object, according to the present invention, there is provided a remaining paper detection apparatus for a sheet-fed rotary printing press having a printing press for performing a printing operation, a feed unit for feeding printing paper to the printing press, and a convey path for conveying the paper fed from the feed unit to the printing press, comprising a print switch for setting the printing press to a printing operation mode, remaining paper detection means for detecting a remaining paper sheet on the convey path, and control means for inhibiting the print switch from setting the printing operation mode when a remaining paper sheet is detected by the remaining paper detection means.

DESCRIPTION OF THE PREFERRED EMBODIMENT

The present invention will be described in detail with reference to the accompanying drawings.

Figure 1:
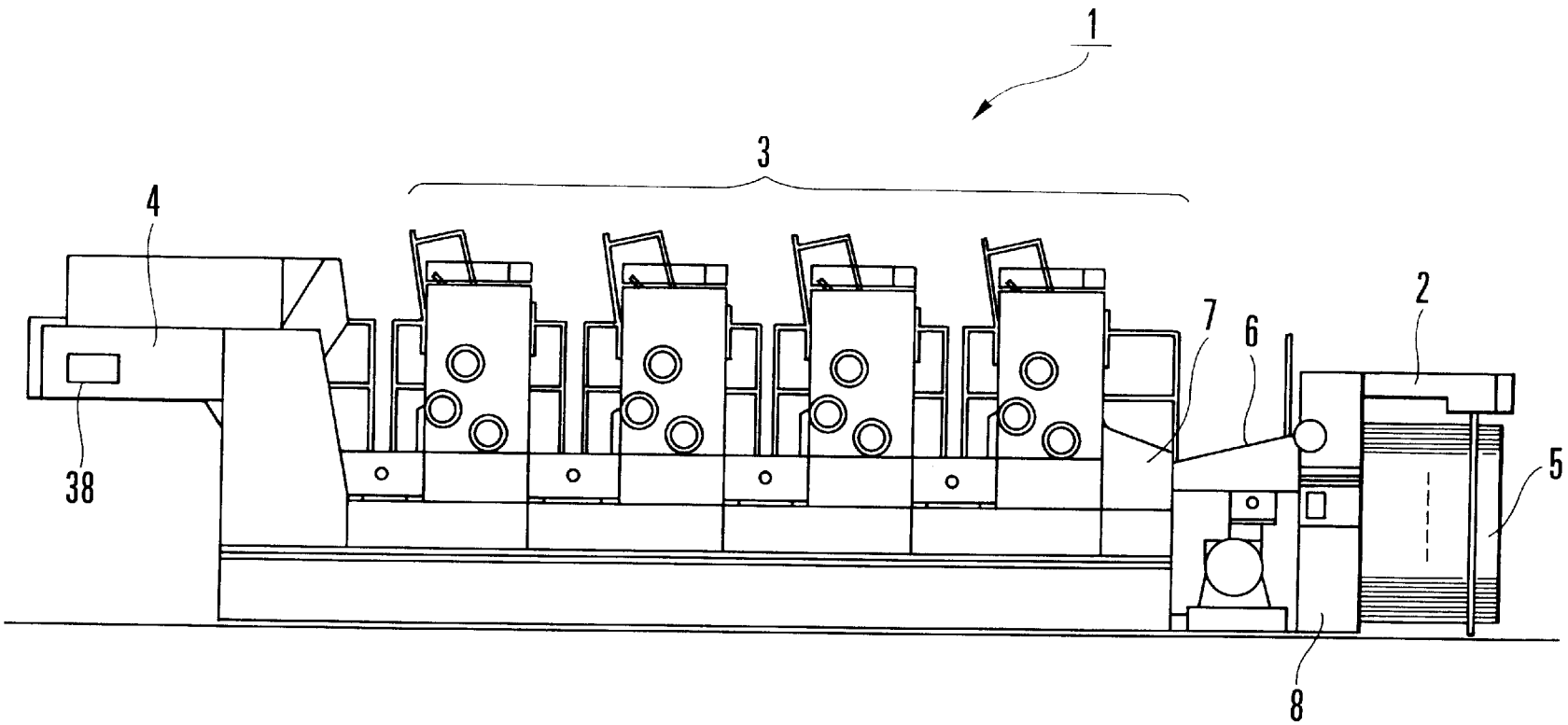
FIG. 1 is a side view schematically showing a sheet-fed rotary printing press according to an embodiment of the present invention.

FIG. 1 schematically shows a sheet-fed rotary printing press according to an embodiment of the present invention. Referring to FIG. 1, a sheet-fed rotary printing press entirely indicated by reference numeral 1 is constituted by a feeder 2, a convey board 6, a printing unit 3, and a delivery unit 4. The feeder 2 draws stacked paper sheets 5 one by one by suction with a suction device (not shown). The convey board 6 conveys the paper sheet 5 fed by the feeder 2. The printing unit 3 aligns the paper sheet 5, fed from the feeder 2 through the convey board 6, in the circumferential and lateral directions with a register 7, and thereafter performs printing. The delivery unit 4 discharges the paper sheet 5 printed with the printing unit 3 and stacks it. A feeder operation panel 8 is arranged near the feeder 2 to perform a control operation to conduct various types of tests for the respective portions of the printing press.

Figure 2:
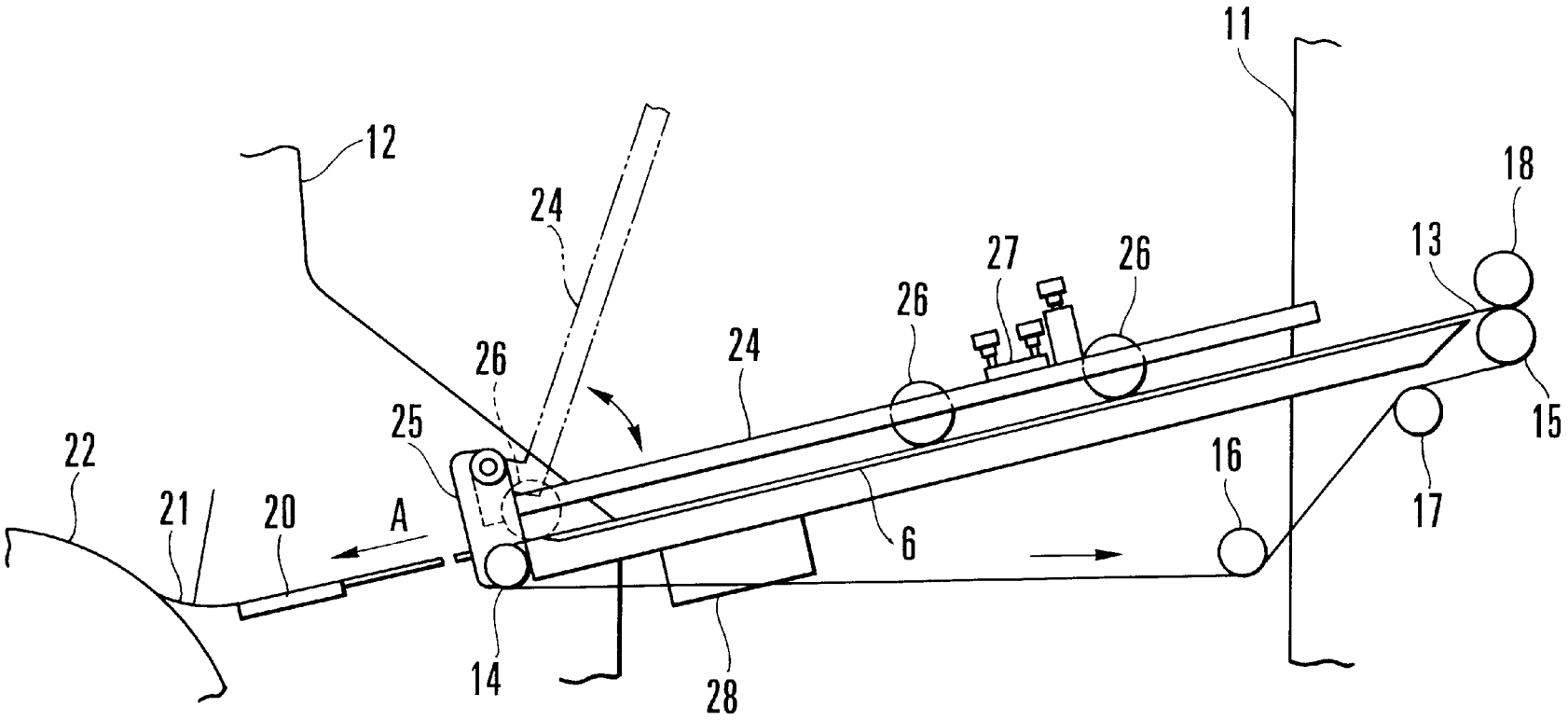
FIG. 2 is a side view of the convey board of the sheet-fed rotary printing press shown in FIG. 1.

The convey board 6 is formed into a rectangular shape, and is supported by front and rear frames 11 and 12 with its two end portions, as shown in FIG. 2, to extend between them in a slightly inclined state. A plurality of conveyor tapes 13 are juxtaposed to each other on the convey board 6 at a predetermined distance in a direction perpendicularly intersecting a paper convey direction A, and extend among a plurality of rollers 14, 15, 16, and 17. A feed roller 18 opposes the roller 15 to capture the paper sheets 5, drawn by suction with the suction device (not shown), with the roller 15. The paper sheets 5 captured by the rollers 15 and 18 are fed onto the convey board 6 in a continuous multi-fed state wherein the leading end portion of the subsequent paper sheet 5 overlaps the trailing end portion of the preceding paper sheet 5, and are conveyed by the conveyor tapes 13.

Referring to FIG. 2, a feedboard 20 constitutes the register 7 that aligns the conveyed paper sheets 5 in the circumferential and lateral directions. A swing arm shaft pregripper 21 grips the paper sheet 5 fed onto the feedboard 20 and transfers it to the gripper of an impression cylinder 22.

Above the convey board 6, a convey board frame 24 is arranged in the paper convey direction A. The convey board frames 24 are pivotally supported by brackets 25, as indicated by a solid line and an alternate long and two short dashed line.

Forwarding rolls 26 are supported by support bars (not shown), extending across the convey board frame 24, through leaf springs (not shown) and brackets 27. The forwarding rolls 26 are arranged to oppose the conveyor tapes 13 on the convey board 6, and cooperate with the conveyor tapes 13 to convey the paper sheets 5. A control box 28 is mounted on the lower surface side of the convey board 6 and houses a remaining paper detection controller (to be described later).

Figure 4:
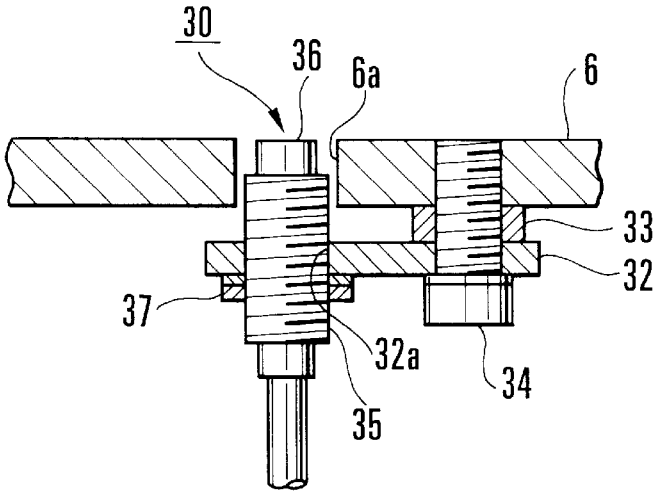
FIG. 4 is an enlarged sectional view of the mounting structure of a remaining paper detection apparatus shown in FIG. 3.

Remaining paper detection apparatuses 30 detect remaining paper sheets on the convey board 6 by a light reflection or transmission scheme. Three remaining paper detection apparatuses 30 are arranged on the convey board 6 in the paper convey direction A to be separated from each other at a pitch smaller than the paper sheet 5 having a minimum paper convey direction length. As shown in FIG. 4, each remaining paper detection apparatus 30 has a detection sensor 36 mounted on the lower surface of the convey board 6 through a support plate 32, such that its distal end portion opposes a small hole 6*a* formed in the convey board 6.

In the remaining paper detection apparatus 30 shown in FIG. 4, the support plate 32 is mounted on the lower surface of the convey board 6 through a spacer 33 with a screw 34. A threaded portion is formed on the outer circumferential portion of a sensor main body 35 of the remaining paper detection apparatus 30, to mesh with a screw hole 32*a* of the support plate 32. When the sensor main body 35 is pivoted, the height of a detection sensor 36 is adjusted. After this adjustment, the detection sensor 36 is fixed to the support plate 32 with a nut 37.

Figure 5:
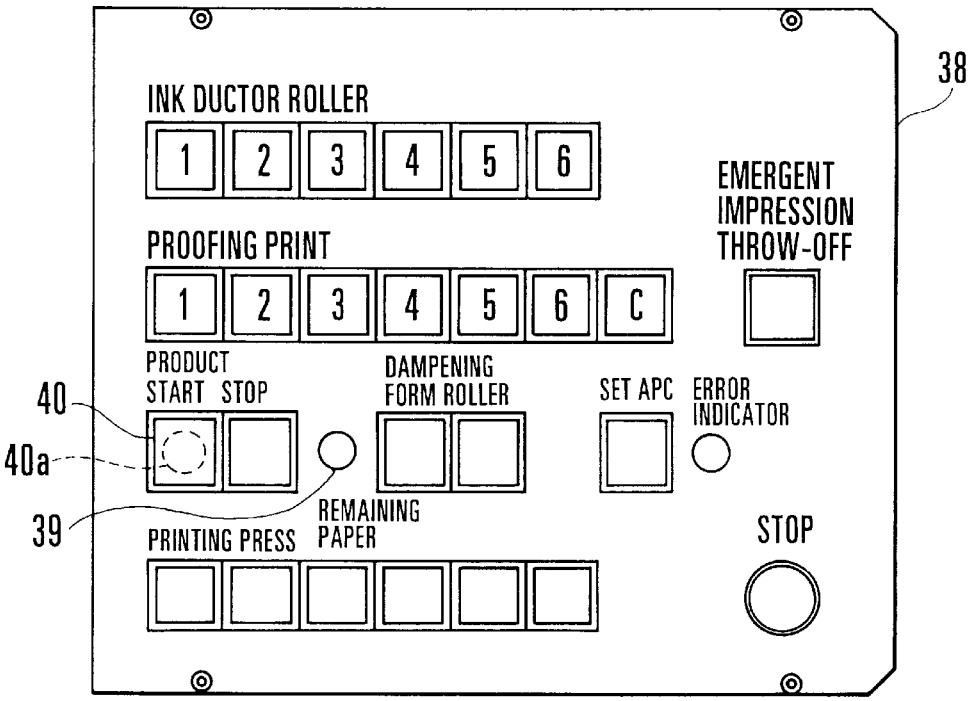
FIG. 5 is an enlarged front view of a control panel shown in FIG. 1.

FIG. 5 shows a control panel 38 provided to the delivery unit 4. The control panel 38 has a remaining paper lamp 39, a product switch 40, and various types of control switches and lamps. The remaining paper lamp 39 indicates the presence of a remaining paper sheet. The product switch 40 repeatedly instructs ON/OFF of the operation of the sheet-fed rotary printing press 1, i.e., interruption and resumption of printing with the printing press 1. The remaining paper lamp 39 is turned on when a remaining paper sheet on the convey board 6 is detected by the remaining paper detection apparatus 30, and is turned off when the remaining paper sheet on the convey board 6 is removed by the operator.

The product switch 40 comprises an automatically reset push button switch and integrally has a switch lamp 40*a* (FIG. 7) which indicates the switch state (ON/OFF state) by ON/OFF. The switch lamp 40*a* repeats ON and OFF in accordance with the ON/OFF operation of the product switch 40, and is controlled to be turned off, upon detection of a remaining paper sheet, while it is ON.

Figure 6:
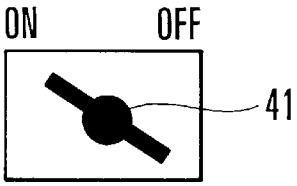
FIG. 6 is a front view of a select switch provided to the sheet-fed rotary printing press shown in FIG. 1.

FIG. 6 shows a select switch 41 provided on the feeder operation panel 8. The select switch 41 turns on/off detection of the remaining paper detection apparatuses 30. When a normal printing operation is to be performed and remaining paper sheet detection is required, the select switch 41 is turned on. When the respective portions of the sheet-fed rotary printing press 1 are to be subjected to various types of tests that are different from the normal printing operation, or when maintenance is to be performed, the select switch 41 is turned off.

Figure 7:
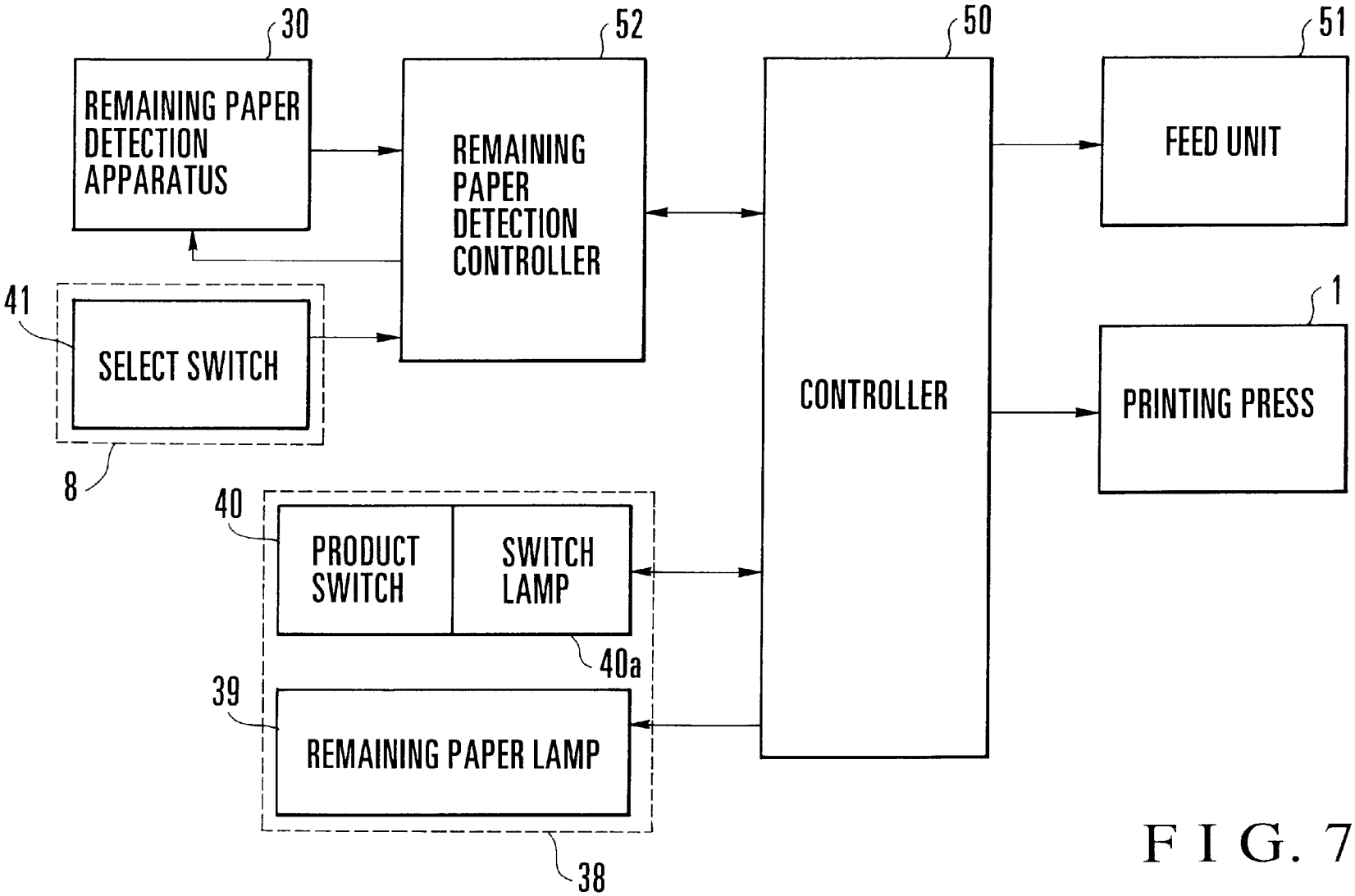
FIG. 7 is a block diagram schematically showing the sheet-fed rotary printing press shown in FIG. 1.

FIG. 7 schematically shows the sheet-fed rotary printing press shown in FIG. 1. Referring to FIG. 7, a controller 50 comprises a CPU (Central Processing Unit) that controls the printing operation. The controller 50 is connected to the printing press 1, the control panel 38 having the remaining paper lamp 39 and product switch 40, a feed unit 51 constituted by the feeder 2, a suction device (not shown), and the like, and a remaining paper detection controller 52. As described above, the product switch 40 is provided with a switch lamp 40*a* that indicates its ON/OFF state.

The remaining paper detection controller 52 is connected to the remaining paper detection apparatuses 30 and the select switch 41 on the feeder operation panel 8. Upon reception of a remaining paper detection signal from the remaining paper detection apparatuses 30, the remaining paper detection controller 52 sends a signal indicating the presence of a remaining paper sheet to the controller 50. Upon reception of the signal indicating the presence of the remaining paper sheet, the controller 50 does not resume the operation even if the operator turns on the product switch 40 that instructs resumption of the operation of the printing press 1. When the switch lamp 40*a* of the product switch 40 is ON (ON state), it is turned off and controlled to be restored to the OFF state.

When the select switch 41 is turned off, the remaining paper detection controller 52 controls the remaining paper detection apparatuses 30 to the disable state. Hence, if the product switch 40 is turned on in this state, the remaining paper detection apparatuses 30 become inoperative regardless of the presence/absence of the remaining paper sheets, and the operation of the printing press 1 is enabled. Hence, even if any remaining paper sheet is present on the convey board 6, various types of tests can be performed.

The remaining paper detection apparatuses 30 are controlled to the disable state when the select switch 41 is OFF. However, the remaining paper detection apparatuses 30 may not be controlled, the remaining paper detection signal from the remaining paper detection apparatus 30 may be neglected, and a signal indicating the presence of a remaining paper sheet may not be sent to the controller 50, as a matter of course.

Figure 8:
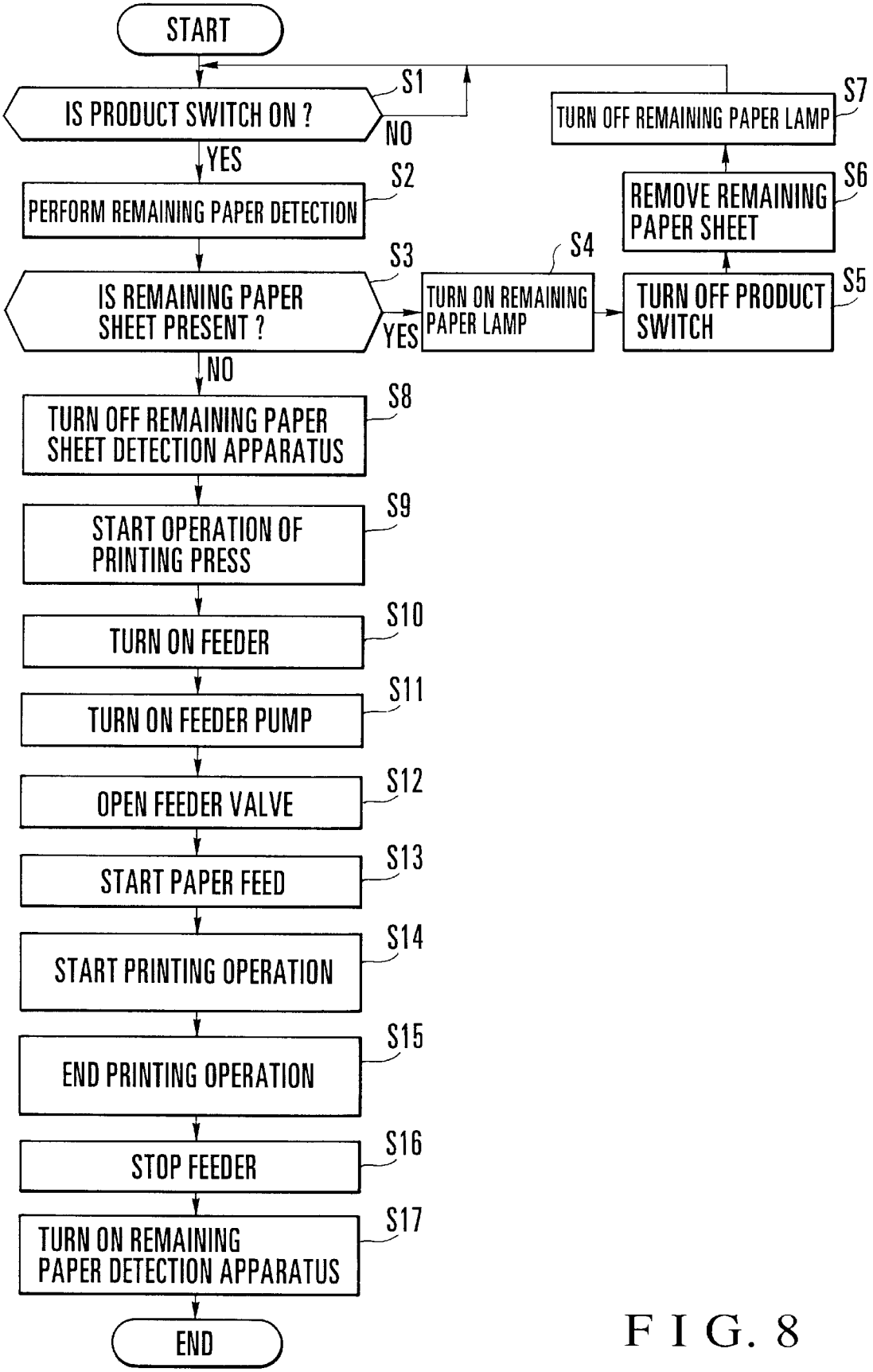
FIG. 8 is a flow chart for explaining the remaining paper detecting operation of the sheet-fed rotary printing press shown in FIGS. 1 and 7.

The remaining paper detecting operation done by the remaining paper detection apparatus for the sheet-fed rotary printing press having the above arrangement will be described with reference to the flow chart of FIG. 8.

When a test or final printing operation is started, the paper sheets 5 stacked on the feeder 2 are drawn by suction with the suction device (not shown) and are separately fed one by one. The paper sheets 5 fed from the feeder 2 are captured between the roller 15 and the feed roller 18, are fed onto the convey board 6, and are conveyed on the convey board 6 with the conveyor tapes 13 and the forwarding rolls 26. The conveyed paper sheets 5 are aligned by the feedboard 20 in the circumferential and lateral directions, and their paper ends are gripped by the swing arm shaft pregripper 21. The paper sheets 5 with their paper ends gripped are transferred to the gripper of the impression cylinder 22, are subjected to printing by the printing unit 3, and are discharged to the delivery unit 4 and stacked on it.

When test or final printing is interrupted, a signal indicating the end of printing operation is sent from the controller 50 to the remaining paper detection controller 52, and the remaining paper detection apparatuses 30 are controlled to the ON state.

Figure 3:
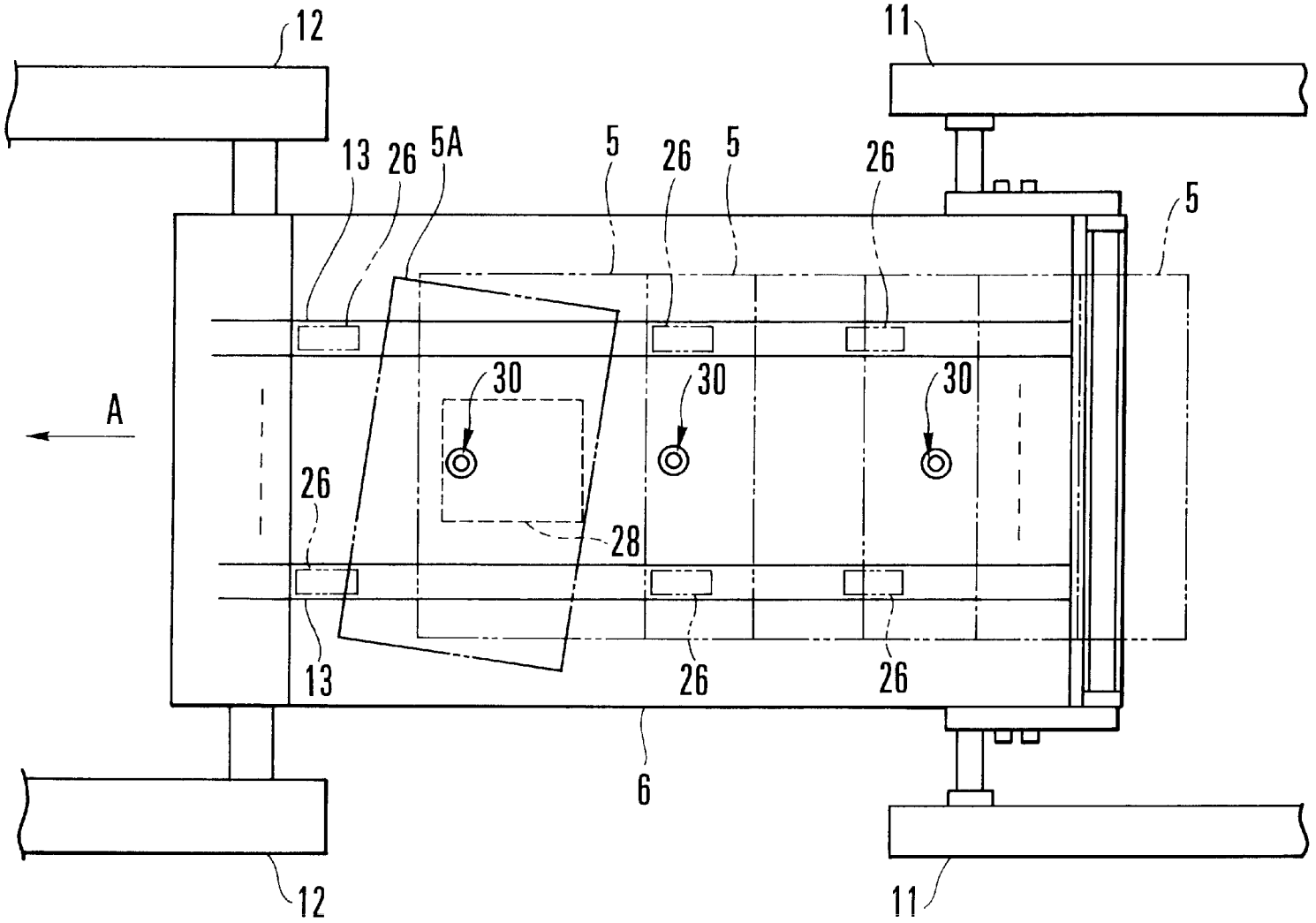
FIG. 3 is a plan view of the convey board shown in FIG. 2.

Subsequently, in order to resume test or final printing, when the product switch 40 is set in turned on (step S1), remaining paper detection on the convey board 6 is performed on the basis of outputs from the remaining paper detection apparatuses 30 (step S2). The remaining paper detection controller 52 determines the presence/absence of the remaining paper sheet on the basis of the outputs from the remaining paper detection apparatuses 30 (step S3). If a remaining paper sheet 5A (FIG. 3) is present, the remaining paper detection controller 52 sends a signal indicating the presence of the remaining paper sheet to the controller 50.

The controller 50 turns on the remaining paper lamp 39 on the control panel 38 to inform the operator of the presence of the remaining paper sheet (step S4). Simultaneously, the switch lamp 40*a* is turned off, and the product switch 40 is restored to the OFF state (step S5). Thereafter, when the operator notices the ON state of the remaining paper lamp 39 and opens the convey board frame 24 and forwarding rolls 26 to remove the remaining paper sheet 5A (step S6), the remaining paper detection controller 52 turns off the remaining paper lamp 39 on the basis of outputs (no remaining paper sheet) from the remaining paper detection apparatuses 30 (step S7). Therefore, the printing press 1 is restored to a state wherein it can perform a normal printing operation.

Even if the operator starts the operation without noticing the ON state of the remaining paper lamp 39, the operations of the printing press 1 and feed unit 51 are not resumed unless the remaining paper sheet 5A is removed. More specifically, the operation of the printing press 1 shown in step S8 (to be described later) and the feeder operation of the feeder 2 shown in steps S9 to S11 are controlled to be stopped.

After confirming turn-off of the remaining paper lamp 39 in step S7, the operator sets the product switch 40 in the ON state again. When the ON state of the product switch 40 is detected in step S1, remaining paper detection is performed on the basis of outputs from the remaining paper detection apparatuses 30 in step S2.

When the absence of any remaining paper sheet is confirmed in step S3, the remaining paper detection controller 52 controls the remaining paper detection apparatuses 30 to the disable (OFF) state (step S8). Subsequently, the operation of the printing press 1 is resumed (step S9), and thereafter paper feed preparation is started (step S10). More specifically, after a feeder pump is turned on (step S11), a feeder valve is opened (step S12), and the paper feed operation is started (step S13). Hence, in the feeder 2, the paper sheets 5 are sent onto the convey board 6 one by one with the paper suction operation of the suction device (not shown), and the printing operation is started (step S14).

After that, when the printing operation is complete (step S15), the paper feed operation of the feed unit 51 is stopped (step S16), the remaining paper detection apparatuses 30 are controlled to the enable (ON) state (step S17), and the process is complete.

According to this embodiment, when printing is resumed, the ON operation of the product switch 40 is invalidated upon reception of remaining paper detection outputs from the remaining paper detection apparatuses 30. Therefore, accidents such as paper tear, damage to the blanket or machine, erroneous paper flow, paper catching into the ink roller, and the like which are caused by the remaining paper are prevented, and the printing quality is stabilized.

Remaining paper visual observation which is conventionally done by the operator becomes unnecessary, and a settling operation accompanying an accident is largely reduced, decreasing the load on the operator.

Since an extra operation time necessitated by interruption and resumption of the paper feed operation is reduced, the productivity is increased. Since the remaining paper lamp 39 is arranged, it can inform the operator of the presence of a remaining paper sheet. The remaining paper lamp 39 is turned off when the remaining paper is removed, to confirm paper removal, thereby increasing the operability.

Since the select switch 41 is arranged, the respective portions of the printing press can be subjected to various types of tests, in addition to the normal printing operation, making the printing press more convenient.

In the above embodiment, when a remaining paper sheet is detected, the product switch 40 is restored from the ON state (the switch lamp 40*a* is ON) to the OFF state (the switch lamp 40*a* is OFF). It suffices if the setting operation of the printing operation mode with the product switch 40 is inhibited.

In the above embodiment, when any remaining paper sheet is not detected, the operations of the printing press 1 and feed unit 51 are started. However, the operation of the printing press 1 may be started when the product switch 40 is turned on, and the feed operation of the feed unit 51 may be started when no remaining paper sheet is further detected. The remaining paper detection apparatuses 30 are set ON while the feeder is kept stopped. However, the apparatuses 30 may be turned on upon detection of the ON state of the product switch 40.

In the above embodiment, the remaining paper detection controller 52 is arranged. However, the remaining paper detection controller 52 may be omitted, and the remaining paper detection apparatuses 30 and the select switch 41 may be directly connected to the controller 50.

In the above embodiment, the presence of a remaining paper sheet is informed by turning on the remaining paper lamp 39 as the informing means. However, the informing means may be a sound means, e.g., a buzzer.

As has been described above, according to the present invention, the printing quality is stabilized, and the productivity is improved. The load on the operator is reduced, and the operability is improved. Also, the printing press can be used more conveniently.

What is claimed is:

1. In a sheet-fed rotary printing press having a printing press for performing a printing operation, a feed unit for feeding at least one printing paper to said printing press, each paper having a leading end and a trailing end, and a convey path for conveying the paper fed from said feed unit to said printing press, a remaining paper detection apparatus comprising:

a print switch for setting said printing press to a printing operation mode;

remaining paper detection means for detecting remaining paper sheets on said convey path; and control means for inhibiting said print switch for setting the printing operation mode when a remaining paper sheet is detected by said remaining paper detection means, wherein a second sheet of paper is fed to said printing press by the feed unit so that the leading end of the second paper overlays the trailing end of a first sheet of paper and wherein the control means stops the operation of the remaining paper detection means subsequent to remaining paper detection means not detecting a remaining paper sheet.

2. An apparatus according to claim 1, wherein said remaining paper detection means comprises a plurality of detection sensors arranged in a paper convey direction at pitches smaller than a minimum paper sheet length.

3. In a sheet-fed rotary printing press having a printing press for performing a printing operation, a feed unit for feeding printing paper to said printing press, and a convey path for conveying the paper fed from said feed unit to said printing press, a remaining paper detection apparatus comprising:

a print switch for setting said printing press to a printing operation mode;

remaining paper detection means for detecting remaining paper sheets on said convey path; and control means for inhibiting said print switch for setting the printing operation mode when a remaining paper sheet is detected by said remaining paper detection means, said convey path having a rectangular convey board, a conveyor belt that extends on said convey board in a direction perpendicular to a paper feed direction and is driven in the paper feed direction, a plurality of rollers in rotatable contact with said conveyor belt on a convey surface of said convey board, and a support member that supports said rollers and separates said rollers from the conveying surface of said convey board, wherein the remaining paper sheet is removed from said rectangular convey board when said rollers are separated from the convey surface of said convey board by operation of said support member.

4. An apparatus according to claim 1, wherein said print switch comprises an automatically reset push button switch that repeats an ON state and an OFF state in response to an operation, and said control means electrically resets said print switch in the ON state to the OFF state in accordance with a remaining paper detection output from said remaining paper detection means.

5. An apparatus according to claim 1, further comprising informing means for informing the presence of a remaining paper sheet when the remaining paper sheet is detected by said remaining paper detection means.

6. An apparatus according to claim 1, wherein said apparatus further comprises a select switch for turning on/off a remaining paper detecting operation of said remaining paper detection means, and said control means controls said remaining paper detection means to a disable state when said select switch is OFF.

7. An apparatus according to claim 1, wherein said apparatus further comprises a select switch for turning on/off a remaining paper detecting operation of said remaining paper detection means, and said control means neglects an output from said remaining paper detection means when said select switch is OFF.

8. An apparatus according to claim 1, wherein said remaining paper detection means performs a remaining paper detecting operation when said print switch is operated, and said control means starts operations of said printing press and said feed unit when a remaining paper sheet is not detected by said remaining paper detection means.

9. An apparatus according to claim 1, wherein said printing press repeats interruption and resumption of printing, and said remaining paper detection means detects whether or not a remaining paper sheet is present when resumption of printing of said printing press is instructed by said print switch.

10. The apparatus of claim 1, wherein said control means places said remaining paper detection means in a disable state when the output of said remaining paper detection means indicates that no remaining paper sheet is detected.

* * * * *

UNITED STATES PATENT AND TRADEMARK OFFICE

CERTIFICATE OF CORRECTION

PATENT NO. : 5,983,796
DATED : November 16, 1999
INVENTOR(S) : Ishida et al.

It is certified that error appears in the above-identified patent and that said Letters Patent is hereby corrected as shown below:

Title page,
Item [30], Foreign Application Data, delete application number "9-256532" and insert -- 256532/1997 --.

Item [56], FOREIGN PATENT DOCUMENTS, delete reference number "2013632" and insert -- 2013632 A --; and delete reference number "2192584" and insert -- 2192584 A --.

Signed and Sealed this

Eighth Day of January, 2002

*Attest:*

*Attesting Officer*

JAMES E. ROGAN
*Director of the United States Patent and Trademark Office*